US009377192B2

(12) United States Patent
Hirata et al.

(10) Patent No.: US 9,377,192 B2
(45) Date of Patent: Jun. 28, 2016

(54) COMBUSTOR

(75) Inventors: Yoshitaka Hirata, Tokai (JP); Shohei Yoshida, Hitachiota (JP); Tatsuya Sekiguchi, Hitachinaka (JP); Akinori Hayashi, Hitachinaka (JP); Hirokazu Takahashi, Hitachinaka (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 1079 days.

(21) Appl. No.: 13/472,690

(22) Filed: May 16, 2012

(65) Prior Publication Data

US 2012/0291446 A1 Nov. 22, 2012

(30) Foreign Application Priority Data

May 20, 2011 (JP) ..... 2011-112988

(51) Int. Cl.

| | |
|---|---|
| ***F02C 1/00*** | (2006.01) |
| ***F23D 11/40*** | (2006.01) |
| ***F23D 14/62*** | (2006.01) |
| ***F23R 3/04*** | (2006.01) |
| ***F23R 3/12*** | (2006.01) |
| ***F23R 3/28*** | (2006.01) |

(Continued)

(52) U.S. Cl.

CPC ..... *F23D 11/402* (2013.01); *F23D 14/62* (2013.01); *F23R 3/04* (2013.01); *F23R 3/12* (2013.01); *F23R 3/286* (2013.01); *F23R 3/36* (2013.01); *F23C 7/002* (2013.01); *F23D 2900/14021* (2013.01)

(58) Field of Classification Search

CPC ..... F23R 3/286; F23R 3/36; F23R 3/10; F23R 3/12; F23C 7/002; F23D 11/107

See application file for complete search history.

(56) References Cited

U.S. PATENT DOCUMENTS

| | | | |
|---|---|---|---|
| 5,488,829 | A | 2/1996 | Southall et al. |
| 5,899,074 | A | 5/1999 | Komatsu et al. |
| 2004/0255589 | A1 | 12/2004 | Yoshida et al. |

(Continued)

FOREIGN PATENT DOCUMENTS

| | | | |
|---|---|---|---|
| JP | 7-280267 | A | 10/1995 |
| JP | 7-324749 | A | 12/1995 |

(Continued)

OTHER PUBLICATIONS

Japanese Office Action with English Translation Dated Jun. 18, 2013 (Eight (8) pages).

*Primary Examiner* — Gerald L Sung
(74) *Attorney, Agent, or Firm* — Crowell & Moring LLP

(57) ABSTRACT

A highly-reliable combustor is provided that allows flash back of flame into a premixer to be suppressed.

The combustor has a mixing chamber forming member 110 that forms a mixing chamber thereinside. The mixing chamber includes a first mixing chamber 200 broadening toward a downstream side. The member 110 includes air introduction holes 202, 203, 204 formed in a plurality of rows in an axial direction, with the air introduction holes being arranged plurally in a circumferential direction of the mixing chamber. The member 110 includes a fuel ejection hole 206 provided in a wall surface which forms the air introduction hole. The air introduction holes 202, 203, 204 are circumferentially eccentrically installed. The air introduction holes 202 located in the most upstream row are more inclined toward the downstream side than the air introduction holes 203, 204 located in the rows other than the most upstream row.

13 Claims, 4 Drawing Sheets

(51) Int. Cl.
*F23R 3/36* (2006.01)
*F23C 7/00* (2006.01)

(56) References Cited

U.S. PATENT DOCUMENTS

2006/0127827 A1 6/2006 Yoshida et al.
2009/0173057 A1* 7/2009 Yoshida et al. ..... 60/39.281

FOREIGN PATENT DOCUMENTS

JP 11-507433 A 6/1999
JP 2005-147459 A 6/2005
JP 2005-344981 A 12/2005
JP 2006-105488 A 4/2006
JP 2007-17023 A 1/2007
JP 2009-85456 A 4/2009

* cited by examiner

COMBUSTOR

BACKGROUND OF THE INVENTION

1. Field of the Invention

The present invention relates to a gas turbine combustor.

2. Description of the Related Art

Gas turbine systems are known in which a premix combustion type combustor is used to suppress the occurrence of a local high-temperature region to reduce thermal NOx. The premix combustion type combustor is such that fuel and air are previously mixed in a premixer and the mixture is fed to a combustion chamber for combustion. A number of combustors employing premix combustion have been proposed. Such a combustor is described as one example in JP-7-280267-A.

SUMMARY OF THE INVENTION

As a premixer configuration has been complicated in recent years, also the flow of fuel and air flowing through thereinside has been complicated. This leads to a problem in that a low flow rate region and a back-flow region are likely to occur, which will potentially increase the occurrence of flash back. It is an object of the present invention to provide a highly-reliable combustor that allows flash back into a premixer to be suppressed.

According to an aspect of the present invention, there is provided a combustor including: a mixing chamber forming member that forms a mixing chamber thereinside; a first mixing chamber defined in the mixing chamber, the first mixing chamber broadening toward a downstream side, the mixing chamber forming member including air introduction holes formed in a plurality of rows in an axial direction, with the air introduction holes being arranged plurally in a circumferential direction of the mixing chamber, the mixing chamber forming member including a fuel ejection hole provided in a wall surface in which the air introduction holes are provided. In the combustor, the air introduction holes are circumferentially eccentrically installed, and those located in a most upstream row are more inclined toward the downstream side than the air introduction holes located in a row other than the most upstream row.

The present invention can provide the highly-reliable combustor that allows flash back into the premixer to be suppressed.

DESCRIPTION OF THE PREFERRED EMBODIMENTS

Figure 1:
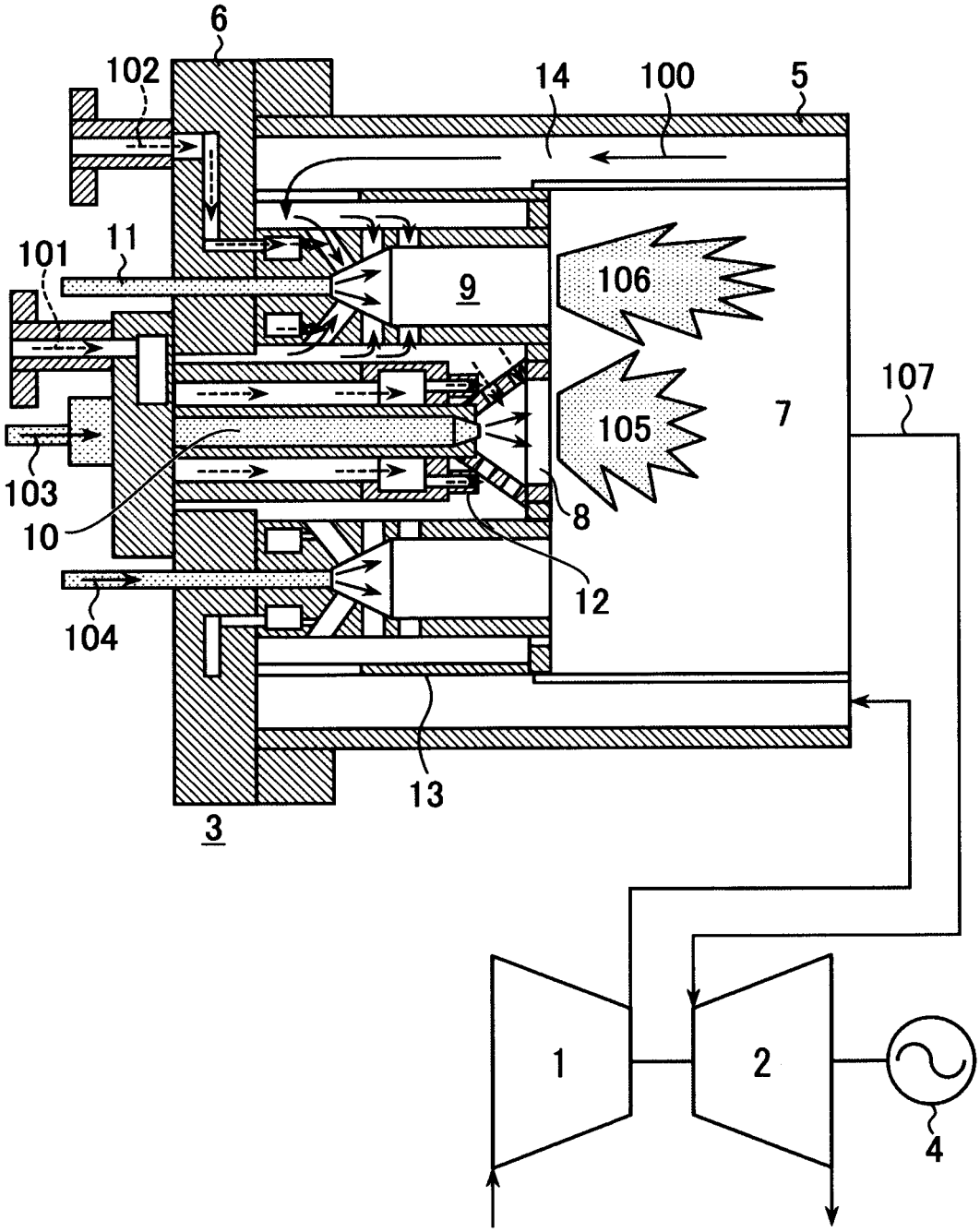
FIG. 1 is a longitudinal cross-sectional view of a combustor according to one embodiment.

Environmental issues have gained prominent attention in recent years, and also gas turbine combustors have been required a reduction in environmental burden. Therefore, reducing the amount of NOx emissions is an important development subject. Furthermore, countermeasures against global warming increase a need to use a variety of fuels such as natural gases and bio-based fuels as well as conventional oil fuels. This leads to increase a demand for increasing the options and flexibility for use of fuels.

In the context of such situations, dual-fuel-compatible low-NOx combustors are provided as combustors that can deal with both liquid fuel and gas fuel and reduce the amount of NOx emissions. In general, a method of putting an inactive medium such as water, steam or the like into a combustion field has been provided as a method of reducing the amount of NOx emissions. This method has problems, however, about an increased initial cost, running cost, and being unusable in areas where it is difficult to obtain water to be putted in. The premixed combustion has been proposed for solving such a problem. This premixed combustion is a method in which fuel and air are previously mixed together in a premixer and the mixture is fed to a combustion chamber for combustion. The premixed combustion suppresses the occurrence of a local high-temperature region, thereby allowing for reduced thermal NOx.

Many combustors employing premixed combustion are proposed. One example of such combustors is described in JP-7-280267-A. A problem about premixed combustion is occurrence of flash back in which flames are held inside a mixing chamber for mixing fuel and air. This is because the mixing of fuel and air is promoted to produce a lean combustible mixture for combustion. Thus, the combustors employing premixed combustion are required high reliability for such a problem.

As described above, flash back is an event in which flames are formed inside the mixing chamber for mixing fuel and air. The occurrence of flash back may probably burn out the mixing chamber in some cases. Therefore, it is an important problem to absolutely prevent the occurrence of flash back in combustors employing premixed combustion. Causes of the occurrence of flash back include back-flow of premixed flames formed downstream of the mixing chamber, auto-ignition of fuel, and ignition of foreign matter mixed with fuel or air. Due to such events, a combustible mixture continuously burns in a low flow-rate region or a back flow region inside the mixing chamber.

In order to achieve the further reduced amount of NOx emissions, a wide variety of premixer structures have been proposed that can promote the mixing of fuel and air in recent years. However, as the premixer structures are complicated, also the flows of fuel and air are complicated, so that a low flow-rate region and a back flow region become easy to be formed. This poses a problem in that the occurrence of flash back is potentially increased.

As an example of the complicated structures of premixer, a combustor described in FIG. 2 of JP-2006-105488-A is provided. This combustor has about the axis thereof a liquid fuel nozzle from which a mixing chamber conically broadening with a plural rows of and a plurality of air holes arranged around the mixing chamber. In the combustor as described in paragraphs 0018 to 0020 and so on, most upstream side air holes are installed such that air flows thereinto generally perpendicularly to the axis, while the air holes other than the most upstream side air holes are installed vertically to the inner surface of the mixing chamber. With this configuration, fluid from the most upstream side air holes is allowed to flow into the vicinity of the ejection position of the fuel nozzle, while the air holes other than the most upstream side air holes are each made to have a small outlet diameter, thereby achieving the compactness of the mixing chamber. However, combustors in which fluid is allowed to flow to the vicinity of the ejection position of the fuel nozzle described above have concern about the occurrence of flash back of the flame into the mixer operating as a premixer.

One embodiment of a gas turbine combustor according to the present invention will hereinafter be described with reference to the drawings.

One Embodiment

The one embodiment of the present invention is hereinafter described with reference to FIGS. 1, 2A, 2B, 3, 4A and 4B. FIG. 1 includes a longitudinal cross-sectional view showing a configuration of a gas turbine combustor of the one embodiment according to the present invention and a schematic diagram showing the entire configuration of a gas turbine plant provided with the gas turbine combustor.

The gas turbine plant shown in FIG. 1 mainly includes a compressor 1, a combustor 3 and a turbine 2. The compressor 1 compresses air to produce high-pressure air for combustion. The combustor 3 mixes fuel with air 100 for combustion led from the compressor 1 and produces combustion gas 107. The turbine 2 is driven by the combustion gas 107 produced by the combustor 3. Incidentally, the compressor 1, the turbine 2 and the generator 4 have respective shafts connected to each other.

The combustor 3 includes an internal cylinder (an combustion chamber) 7, a transition piece not shown, an external cylinder 5 and an end cover 6. The combustion chamber 7 is adapted to burn the air 100 and fuel to produce the combustion gas 107. The transition piece is adapted to lead the combustion gas 107 from the combustion chamber 7 to the turbine 2. The external cylinder 5 houses the combustion chamber 7 and the transition piece.

A diffusion combustion burner 8 is located at an axial central position upstream of the combustion chamber 7. A plurality of premix combustion burners 9 effective for reducing NOx are arranged around the diffusion combustion burner 8. A burner fixation body 13 for holding the burners is disposed on the outer circumference of the diffusion combustion burner 8 and the premix combustion burners 9. A liquid fuel nozzle 10 adapted to eject liquid fuel 103 is disposed at an axial central position upstream of the burner 8. Liquid fuel nozzles 11 adapted to eject liquid fuel 104 are arranged at respective axial central positions upstream of the corresponding burners 9. Incidentally, in the present embodiment, the axis means a central axis of each of the burners. In addition, in the axial direction, the side of the liquid fuel nozzles 10, 11 shall be called the upstream and the side of the combustion chamber 7 shall be called the downstream.

Figure 2A:
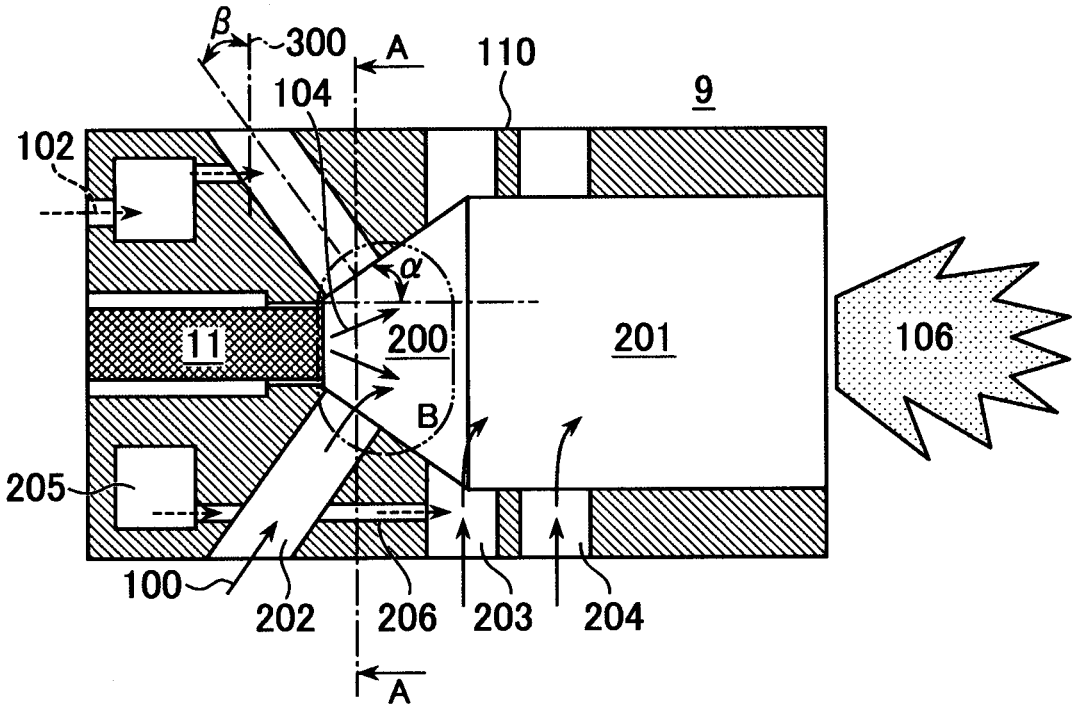
FIG. 2A is a longitudinal cross-sectional view of a premix combustion burner according to the one embodiment.
Figure 2B:
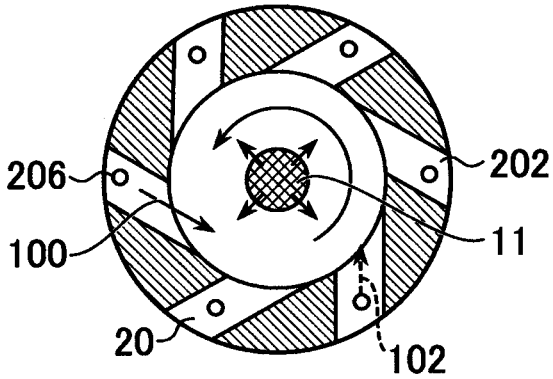
FIG. 2B is a cross-sectional view taken along arrow A-A in FIG. 2A.

FIG. 2A is a longitudinal cross-sectional view of the premix combustion burner 9 according to the one embodiment of the present invention. FIG. 2B is a cross-sectional view taken along arrow A-A in FIG. 2A. The premix combustion burner 9 has a mixing chamber forming member 110 formed with a mixing chamber therein. In addition, the premix combustion burner 9 has a first mixing chamber 200 as part of the mixing chamber. The first mixing chamber 200 is broadened from the liquid fuel nozzle 11 to form a hollow conical shape in order to promote mixing of fuel and air. Further, the premix combustion burner 9 has a second mixing chamber 201 having a cylindrical shape, as part of the mixing chamber. The second mixing chamber 201 is located downstream of the first mixing chamber 200 in order to promote mixing of fuel and air and evaporation of the liquid fuel 104 ejected from the liquid fuel nozzle 11. Three rows of air introduction holes 202, 203, 204 adapted to introduce the air 100 into the first and second mixing chambers 200, 201 are axially formed in the wall surfaces of the first and second mixing chambers 200, 201. The air introduction holes are circumferentially plurally formed in each of the rows.

Gas fuel ejection holes 206 are provided in the inside of the air introduction holes 202, 203, 204, i.e., in a wall surface which forms each of the air introduction holes 202, 203, 204 of the mixing chamber forming member 110. A gas fuel manifold 205 adapted to supply fuel to the gas fuel ejection holes 206 is formed at a position upstream of the premix combustion burner 9. The gas fuel manifold 205 communicates with each of the air introduction holes 202, 203, 204 via a corresponding gas fuel ejection hole 206. The gas fuel ejection hole 206 is adapted to eject gas into the inside of each of the air introduction holes 202, 203, 204.

The premix combustion burner 9 of the present embodiment is designed so that gas fuel is ejected from the gas fuel ejection holes 206 and liquid fuel is ejected from the liquid fuel nozzle 11. Thus, the combustor of the present embodiment can be made as a dual combustor capable of dealing with both fuels, i.e., gas fuel as well as liquid fuel.

The air introduction holes 202, 203, 204 formed in the premix combustion burner 9 are circumferentially eccentrically arranged. The circumferentially eccentric arrangement means that the central axis of the air introduction hole does not intersect the axis as shown in FIG. 2B. With this arrangement, swirl flows can be formed inside the first and second mixing chambers 200, 201.

As shown in FIG. 2A, it is assumed that an angle between the conical surface and axis of the first mixing chamber 200 is $\alpha$ and an inclined angle of the air introduction hole 202 located on the most upstream row is $\beta$. Incidentally, the conical surface is defined as a plane of the first mixing chamber 200 provided with the air introduction hole. In addition, the inclined angle of the air introduction hole 202 is defined as the angle $\beta$ between the central axis of the air introduction hole 202 and a line 300 perpendicular to the axis.

In the premix combustion burner 9 of the combustor configured as above according to the present embodiment, the air introduction holes 202, which are formed in the most upstream row among the three rows of the air introduction holes 202, 203, 204 formed in the axial direction, are inclined by $\beta$ degrees with respect to the line 300 perpendicular to the central axis of the premix combustion burner 9. In addition, the other air introduction holes 203, 204 are formed vertically to the central axis of the premix combustor burner 9. In other words, the air introduction holes 202 provided on the most upstream row are each such that an outlet is located downstream of an inlet. In addition, the air introduction holes 203, 204 provided in the rows other than the most upstream row are each such that an inlet and an outlet have the same axial position. Taking into account also flame stabilization, the outlet of the air introduction hole 202 is generally located close to the ejection hole of the liquid fuel nozzle 11. Thus, the inlet of the air introduction hole 202 is located upstream of the outlet of the liquid fuel nozzle 11.

Figure 4A:
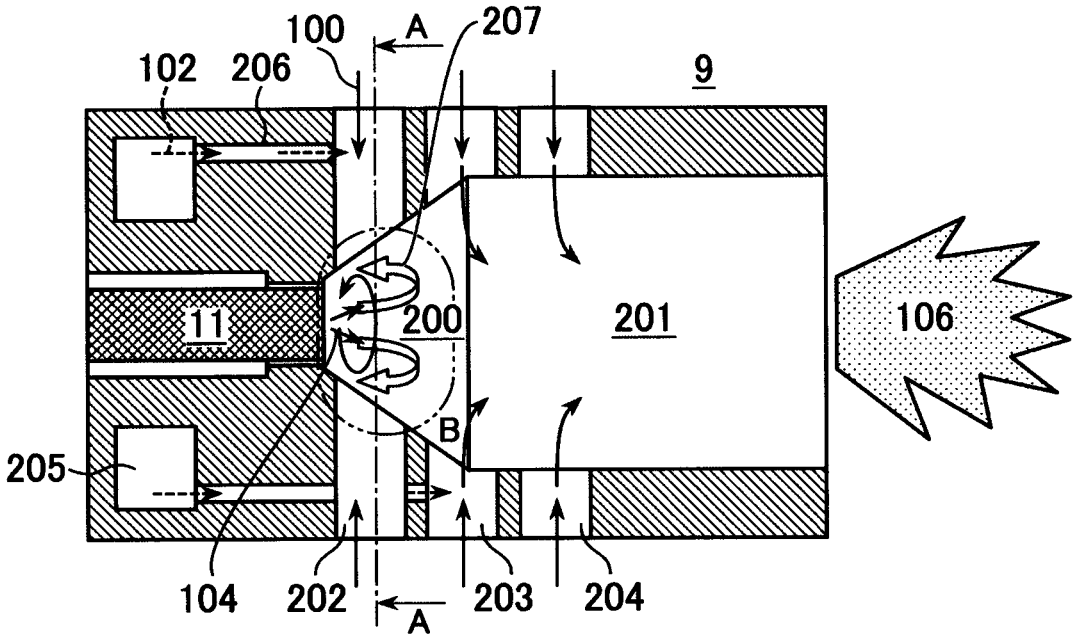
FIG. 4A is a longitudinal cross-sectional view of a premix combustion burner as a comparative example.
Figure 4B:
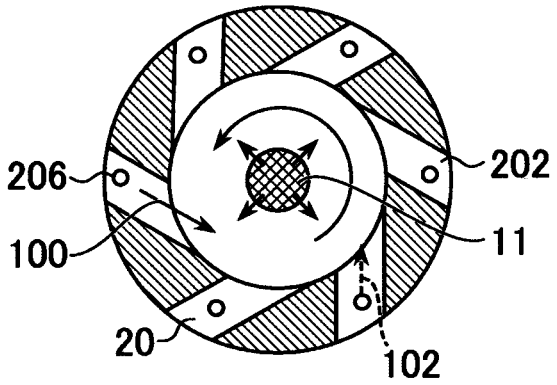
FIG. 4B is a cross-sectional view taken along arrow A-A in FIG. 4A.

The characteristics of the combustor configured as above in accordance with the present embodiment are described with reference to a comparative example. FIG. 4A is a longitudinal cross-sectional view of a premix combustion burner 9 as a comparative example, schematically showing air flow. FIG. 4B is a cross-sectional view taken along arrow A-A in FIG. 4A. The premix combustion burner 9 of the comparative example is such that all air introduction holes 202, 203, 204 are formed vertically to the axis of the premix combustion burner 9. For such a comparative example, an upstream portion (a B-portion) of a first mixing chamber 200 becomes a stagnating area. Furthermore, a low-speed circulating flow 207 is formed due to an effect of a swirl flow formed by the air flowing from the air introduction holes 202.

If the circulating flow 207 is formed inside the first mixing chamber 200 in which fuel and air mix with each other to produce a combustible mixture, a problem may occur in some cases. For example, if premixed flame 106 normally formed downstream of the second mixing chamber 201 flow backward into the first and second mixing chambers 200, 201, flames are held in the region of the circulating flow 207, which leads to a possibility of burning-out of the premix combustion burner 9. If foreign matter with low ignition temperature mixes with the gas fuel 102, the liquid fuel 104 or the air 100, then the air 100 is heated as high as 300° C. or higher. The foreign matter is subjected to the heat of the air 100 to ignite automatically. Thus, the igniting foreign matter may probably act as a source for making a fire and form flames in the circulating flow region 207.

On the other hand, in the one embodiment of the present invention shown in FIG. 2A, the air introduction hole 202 is inclined by β degrees, so that an axial-flow component is sufficiently added to the air 100 flowing into the mixing chamber 200 from the air introduction holes 202. In this way, the circulating flow 207 can be suppressed so that flames are not held inside the first mixing chamber 200. Thus, the highly-reliable combustor can be provided.

A description is here given of the reason for inclining only the air introduction holes 202 in the most upstream row. Staying time of fuel and air inside the mixing chambers 200, 201 largely affects the mixing degree of fuel and air and the degree of evaporation of liquid fuel. In view of this point, it is desirable that the air introduction holes 202, 203, 204 are formed vertically to the axis of the premix combustion burner in order to improve the mixing degree of fuel and air and the evaporating performance of the liquid fuel. However, in this case, the circulating flow is formed inside the mixing chamber 200 as described above, flames are held thereinside, which leads to the possibility of damage to the premix combustion burner 9. To eliminate such a possibility, only the air introduction holes 202 in the most upstream row among three rows formed in an axial direction are inclined relative to the central axis, thereby achieving both the maintenance of the burning performance and the prevention of flame-holding.

However, if the air introduction hole 202 in the most upstream row is excessively inclined in order to increase the effect of preventing flame-holding, the axial-flow component of the air 100 is increased to reduce the staying time of fuel and air inside the combustion chambers 200, 201. Therefore, the mixing performance of fuel and air and the evaporating performance of liquid fuel are degraded. This may lead to a possibility that combustion performance such as the increased amount of NOx emissions is significantly lowered. As described above, the inclined angle of the air introduction hole 202 has an appropriate range. Its details are described below.

Figure 3:
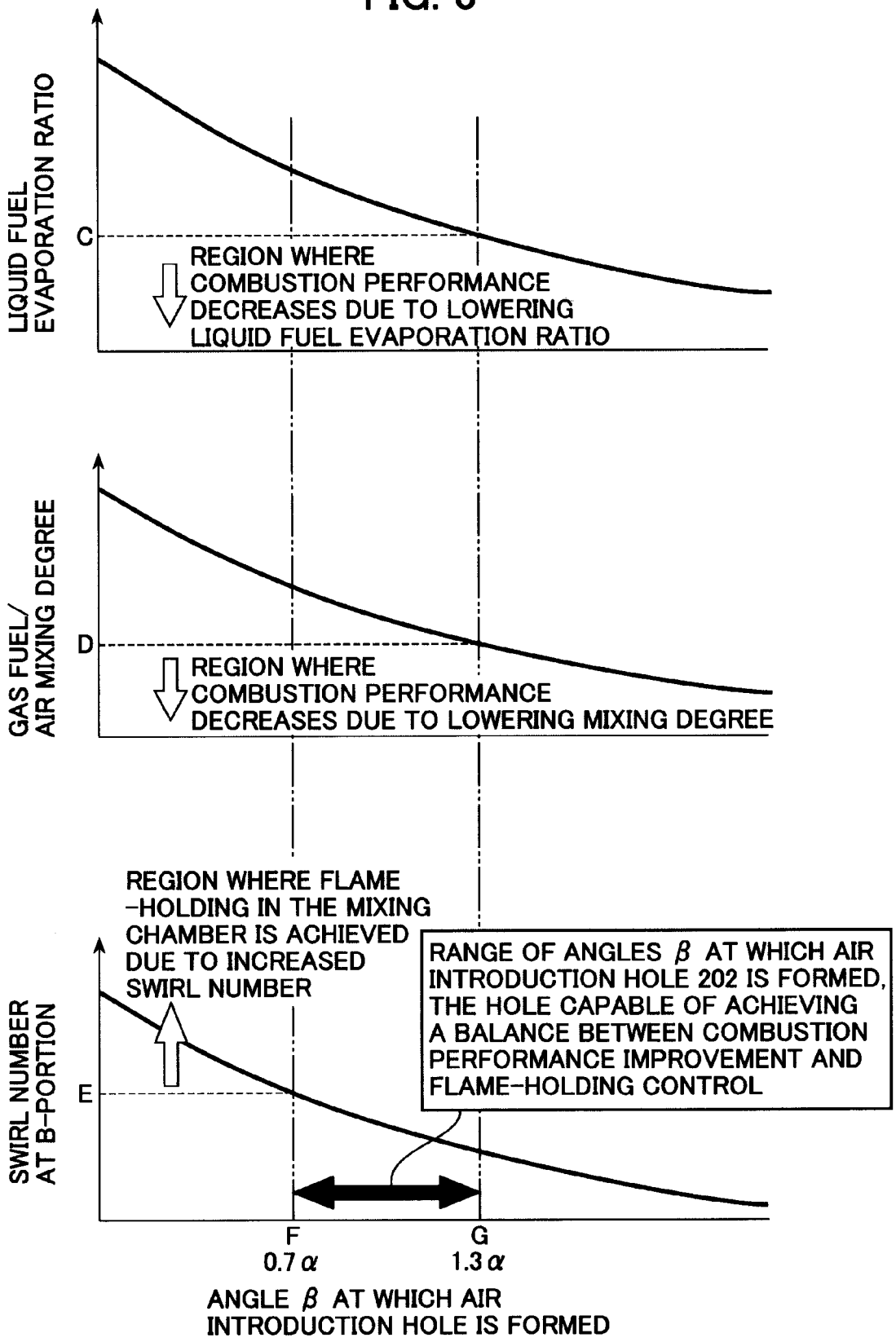
FIG. 3 shows various characteristics for air introduction hole formation angles according to the one embodiment.

FIG. 3 shows various characteristics of, from above, an evaporation ratio of liquid fuel, the degree of mixing of gas fuel and combustion air, and a swirl number at a position upstream (the B-portion) of the mixing chamber 200 each relative to the inclination angle β of the most upstream row air introduction hole 202. All have the characteristic to lower as the inclined angle β is increased. Incidentally, if the evaporation ratio of liquid fuel and the degree of mixing of gas fuel and air lower, then combustion performance such as the increased amount of NOx emissions lowers. On the other hand, if the swirl number is high, then the axial flow rate lowers, which forms the circulating flow 207. Thus, it becomes easy for flames to be held inside the mixing chamber 200.

Accordingly, it is desirable to bring the evaporation ratio of liquid fuel and the degree of mixing of gas fuel and air to a C-point or higher and a D-point or higher, respectively. In contrast, it is desirable to bring the swirl number to an E-point or lower. The inclined angle β that achieves a balance between such desires lies between an F-point and a G-point.

The F-point and the G-point are here shown in the concrete. If the angle α of the conical surface of the mixing chamber 200 with respect to the axis of the premix combustion chamber 9 is set between 30 and 40 degrees, the inclined angle β at the F-point is 0.7α and the inclined angle β at the G-point is 1.3α. In short, in order for the inclined angle β to fall within this range it is desirable that the inclined angle β be set in a range between 0.7α and 1.3α.

The combustor of the present embodiment described above has the mixing chamber forming member 110 formed with the mixing chamber thereinside. This mixing chamber has the first mixing chamber 200 broadening toward the downstream side. The mixing chamber forming member 110 has the air introduction holes 202, 203, 204 formed in the plurality of rows in the axial direction and also formed plurally in the circumferential direction of the mixing chamber. The combustor includes the fuel ejection holes 206 formed in the wall surface each of the air introduction holes 202, 203, 204. In this combustor, the air introduction holes 202, 203, 204 are circumferentially eccentrically provided. The air introduction holes 202 provided in the most upstream row are more inclined toward the downstream side than the air introduction holes 203, 204 provided in the rows other than the most upstream row. The inclination toward the downstream side means that the outlet is located axially downstream of the inlet. The axial-flow component can be added to the mixed fluid of fuel and air from the air introduction holes 202 in the most upstream row.

If the combustor described above is used, gas fuel can be ejected from the fuel injection holes 206 to produce swirl flows in the mixing chamber. In addition, air is supplied so that air and liquid fuel from the air introduction holes 202 in the most upstream row may have the strongest axial-flow component. As a result of the operation of such a combustor, the occurrence and growth of the circulating flow 207 can be suppressed. This suppresses the flash back of the flame into the first mixing chamber 200 and the second mixing chamber 201 operating as the mixer. Thus, the reliability of the combustor can be enhanced.

What is claimed is:

1. A combustor comprising:

a mixing chamber forming member that forms a mixing chamber inside thereof;

a first mixing chamber defined in the mixing chamber, the first mixing chamber broadening toward a downstream side;

the mixing chamber forming member including air introduction holes formed in a plurality of rows in an axial direction, with the air introduction holes being arranged plurally in a circumferential direction of the mixing chamber; and the mixing chamber forming member including a fuel ejection hole, the fuel ejection hole being provided in a wall surface which forms the air introduction hole, a fuel nozzle located about a central axis of the burner, wherein the first mixing chamber has a conical shape broadening from the fuel ejection hole, and wherein the combustor has a cylindrical second mixing chamber located downstream of the first mixing chamber; wherein the air introduction holes are circumferentially eccentrically provided, and wherein the air introduction holes located in a most upstream row are more inclined toward the downstream side than the air introduction holes located in a row other than the most upstream row.

2. The combustor according to claim 1, wherein the air introduction holes located in the most upstream row are each such that an outlet is located on the downstream side in the axial direction more than an inlet, and the air introduction holes located in the at least one row other than the most upstream row are each such that an inlet and an outlet have the same axial position.

3. The combustor according to claim 2, wherein an angle between a conical surface of the first mixing chamber and the axis is $\alpha$ and an inclined angle of the air introduction hole installed in the most upstream row is $\beta$, $\beta$ is set between $0.7\alpha$ and $1.3\alpha$.

4. The combustor according to claim 1, wherein an angle $\alpha$ of the conical surface of the mixing chamber with respect to the axis is set between 30 and 40 degrees.

5. The combustor according to claim 1, wherein the fuel ejection hole is an ejection nozzle adapted to eject gas fuel and the fuel nozzle is a nozzle adapted to eject liquid fuel.

6. The combustor according to claim 1, wherein the air introduction holes located in a most upstream row are more inclined toward the downstream side with respect to lines that are perpendicular to the central axis of the burner than the air introduction holes located in a row other than the most upstream row.

7. A combustor comprising:

a mixing chamber forming member that forms a mixing chamber inside thereof;

a first mixing chamber defined in the mixing chamber, the first mixing chamber broadening toward a downstream side;

the mixing chamber forming member including air introduction holes formed in a plurality of rows in an axial direction, with the air introduction holes being arranged plurally in a circumferential direction of the mixing chamber; and the mixing chamber forming member including a fuel ejection hole, the fuel ejection hole being provided in a wall surface which forms the air introduction hole; wherein the air introduction holes are each disposed such that a central axis thereof does not intersect a burner central axis, and the air introduction holes located in a most upstream row are more inclined toward the downstream side with respect to lines that are perpendicular to the central axis of the burner than the air introduction holes located in a row other than the most upstream row.

8. The combustor according to claim 7, further comprising: a fuel nozzle located about a central axis of the burner, wherein the first mixing chamber has a conical shape broadening from the fuel ejection hole, and wherein the combustor has a cylindrical second mixing chamber located downstream of the first mixing chamber.

9. The combustor according to claim 7, wherein the air introduction holes located in the most upstream row are each such that an outlet is located on the downstream side in the axial direction more than an inlet, and the air introduction holes located in at least one row other than the most upstream row are each such that an inlet and an outlet have the same axial position.

10. The combustor according to claim 9, wherein an angle between a conical surface of the first mixing chamber and the axis is $\alpha$ and an inclined angle of the air introduction hole installed in the most upstream row is $\beta$, $\beta$ is set between $0.7\alpha$ and $1.3\alpha$.

11. The combustor according to claim 8, wherein an angle $\alpha$ of the conical surface of the mixing chamber with respect to the axis is set between 30 and 40 degrees.

12. The combustor according to claim 8, wherein the fuel ejection hole is an ejection nozzle adapted to eject gas fuel and the fuel nozzle is a nozzle adapted to eject liquid fuel.

13. A combustor comprising:

a mixing chamber forming member that forms a mixing chamber inside thereof;

a first mixing chamber defined in the mixing chamber, the first mixing chamber broadening toward a downstream side;

the mixing chamber forming member including air introduction holes formed in a plurality of rows in an axial direction, with the air introduction holes being arranged plurally in a circumferential direction of the mixing chamber; and the mixing chamber forming member including a fuel ejection hole, the fuel ejection hole being provided in a wall surface which forms the air introduction hole; wherein the air introduction holes are circumferentially eccentrically provided, and the air introduction holes located in a most upstream row are more inclined toward the downstream side than the air introduction holes located in a row other than the most upstream row, and the air introduction holes located in the most upstream row are each such that an outlet is located on the downstream side in the axial direction more than an inlet, and the air introduction holes located in the at least one row other than the most upstream row are each such that an inlet and an outlet have the same axial position.

* * * * *